US010569119B2

(12) United States Patent
Endelman et al.

(10) Patent No.: US 10,569,119 B2
(45) Date of Patent: Feb. 25, 2020

(54) COIL SPRING ANCHOR RING RETAINER DEVICE

(71) Applicant: Balanced Body, Inc., Sacramento, CA (US)

(72) Inventors: Ken Endelman, Sacramento, CA (US); Kit W. Spelman, Sacramento, CA (US)

(73) Assignee: BALANCED BODY, INC., Sacramento, CA (US)

( * ) Notice: Subject to any disclaimer, the term of this patent is extended or adjusted under 35 U.S.C. 154(b) by 161 days.

(21) Appl. No.: 15/915,461

(22) Filed: Mar. 8, 2018

(65) Prior Publication Data

US 2019/0275362 A1 Sep. 12, 2019

(51) Int. Cl.
*A63B 21/04* (2006.01)

(52) U.S. Cl.
CPC ..... *A63B 21/0442* (2013.01)

(58) Field of Classification Search
CPC ..... A63B 21/04; A63B 21/06; A63B 21/05
See application file for complete search history.

(56) References Cited

U.S. PATENT DOCUMENTS 944,731 A * 12/1909 Gold ..... F16L 3/2235 248/68.1
1,356,040 A * 10/1920 Caskey ..... F16L 3/14 248/58
1,917,322 A * 7/1933 Peirce, Jr. ..... H01B 17/16 248/68.1
2,285,632 A * 6/1942 Urbain ..... A47F 7/0035 211/60.1
5,197,934 A * 3/1993 Wirtz ..... A63B 21/023 482/123
5,336,142 A * 8/1994 Dalebout ..... A63B 21/00072 482/111
5,765,786 A * 6/1998 Gretz ..... F16L 3/22 248/68.1
5,918,837 A * 7/1999 Vicain ..... H02G 3/26 174/135

(Continued)

FOREIGN PATENT DOCUMENTS

WO WO87/04633 8/1987

OTHER PUBLICATIONS

Balanced Body, Inc. Brochure, p. 11, prior to 2010.

(Continued)

*Primary Examiner* — Garrett K Atkinson
(74) *Attorney, Agent, or Firm* — Greenberg Traurig, LLP

(57) ABSTRACT

A spring ring retainer device is described for retaining a spring ring on a spring anchor in an exercise apparatus such as a Pilates chair. The retainer device eliminates metal to metal contact between the spring ring and the anchor to minimize wear and also provide tactile feedback to a user of proper spring position on the anchor. The device is preferably an elongated unitary body having a central semi-cylindrical portion having a first radius, a first curved end portion, and a semi-cylindrical connector portion joining the first curved end portion to one end of the central semi-cylindrical portion, a second curved end portion and a second semi-cylindrical connector portion joining the second curved end portion with the central semi-cylindrical portion.

20 Claims, 6 Drawing Sheets

(56) References Cited

U.S. PATENT DOCUMENTS 6,030,324 A * 2/2000 McBride ..... A63B 21/072 482/142
6,916,279 B2 * 7/2005 Endelman ..... A63B 21/04 482/123
7,041,040 B2 * 5/2006 Dovner ..... A63B 21/0004 482/124
7,878,954 B2 * 2/2011 McBride ..... A63B 21/023 482/121
7,883,447 B2 * 2/2011 Solow ..... A63B 21/023 297/423.26
7,998,042 B2 * 8/2011 Bowser ..... A63B 21/04 482/121
2002/0137607 A1 * 9/2002 Endelman ..... A63B 21/023 482/123
2003/0078143 A1 * 4/2003 Breibart ..... A63B 21/00072 482/130
2004/0138034 A1 * 7/2004 Endelman ..... A63B 21/04 482/121
2005/0113223 A1 * 5/2005 Dovner ..... A63B 21/0004 482/121
2005/0113224 A1 * 5/2005 Dovner ..... A63B 21/0004 482/121
2009/0098987 A1 * 4/2009 McBride ..... A63B 21/023 482/133
2009/0264266 A1 * 10/2009 Solow ..... A63B 21/023 482/130
2010/0041526 A1 * 2/2010 Bowser ..... A63B 21/04 482/123
2019/0143164 A1 * 5/2019 Bisang ..... A63B 5/11
2019/0175976 A1 * 6/2019 Breland ..... A63B 21/0442

OTHER PUBLICATIONS

Stott Pilates Brochure, prior to 2010.
Gratz Pilates Apparatus, Gratz Industries Brochure, prior to 2010.

* cited by examiner

COIL SPRING ANCHOR RING RETAINER DEVICE

BACKGROUND OF THE DISCLOSURE

Today, many types of exercise equipment are available for fitness and medical purposes. These purposes include improving cardiovascular ability, toning and strengthening muscles, controlling weight, and improving flexibility. Several types of equipment aid a user in this regard by creating some form of effective resistance against repeated body movements.

A Pilates-style combo chair is one such exercise device. The frame of this device is a basic box-like structure designed to rest on a horizontal surface such as a floor and support a user sitting or standing on the top of the chair frame. One or two spring biased pivot arms protrude out of an open front side of the frame. Each of the pivot arms has one end fastened to the rear of the frame. A step support is mounted on the free end of each pivot arm. In order to perform various exercise movements, the user typically sits on or supports his or her body from the top of the chair frame, and steps or presses down on the step support with his or her foot or hand to rotate the pivot arm downward. One or more elastic members, such as coil springs, provide tension against the user's downward movements of the pivot arm or arms. Each end of such a coil spring typically includes a metal ring for attaching that end of the spring to either the step support or the pivot arm and the other end to an anchor structure fastened to the frame of the chair. One such anchor structure is disclosed in U.S. Pat. No. 6,919,279.

The anchor structure in U.S. Pat. No. 6,919,279 is a flat preferably sheet metal plate structure that has an upper attachment portion, a bottom attachment portion, and plurality of arms extending laterally from a central portion between the attachment portions. The attachment portions are fastened to the bottom, or back, and the top rear portion of the chair frame, with the central portion extending upward therebetween with outwardly and upwardly extending side arms resembling a Saguaro cactus shape.

The metal ring extending from the rear end of each of the coil springs attached to the pivot arms is hooked over and onto one of the anchor plate arms to retain the spring in place during exercise. The metal ring at the end of the coil spring loosely fits onto the anchor plate arm. During repeated use of the chair exercise apparatus, these metal rings wear against the anchor plate arms. Therefore there is a need for a snugging and retaining device that operatively retains the spring ring on the anchor plate arm so as to minimize such wear. It would also be helpful if there were some way for a user to easily determine by touch whether the metal ring is securely positioned properly on the anchor plate arm.

SUMMARY OF THE DISCLOSURE

A retainer device in accordance with the present disclosure provides a secure tactile feedback to a user that the end of the elastic member is in proper anchor position. Furthermore, the retainer device in accordance with the present disclosure engages a portion of the spring ring to distribute the retention force on the anchor arm over a larger area of the ring surface and thus snug the ring in position on the anchor plate arm.

Embodiments in accordance with the present disclosure may be viewed as being in an exercise apparatus having a frame, a pivoting member with a proximate end pivotally connected to the frame and a free distal end, and an elastic member having one end fastened to the pivoting member proximate to the distal end of the pivoting member, an anchor device fastening a ring portion of a second end of the elastic member to the frame. This anchor device includes an elongated support member having a central axial portion, an upper mounting portion, and a lower mounting portion. The mounting portions are fastened to the frame. The central axial portion has a plurality of outwardly extending curved arms, wherein each curved arm has a distal end sized to receive and retain the ring portion of the second end of the elastic member.

A ring retaining device in accordance with the present disclosure is fastened to the central axial portion of the anchor device. The retaining device includes an elongated body fastened to the central axial portion of the anchor device. This elongated body includes a central semi-cylindrical portion having a first radius, a first curved end portion, and a semi-cylindrical connector portion joining the first curved end portion to one end of the central semi-cylindrical portion. Preferably the retaining device includes second semi-cylindrical connector portion joining a second curved end portion to an opposite end of the central semi-cylindrical portion. The connector portions each have a radius less than the first radius to receive and retain the ring portion of the second end of the elastic member. Preferably the first curved end portion has a radius less than an inner radius of the spring ring but greater than the radius of the connector portion. The second curved end portion has a radius less than an inner radius of the spring ring but greater than the radius of the first and second connector portions.

A spring ring retainer device for retaining a spring ring on an arm of a spring anchor in a chair exercise apparatus in accordance with the present disclosure may be viewed as including an elongated body adapted to be fastened to the anchor. This body has a central semi-cylindrical portion having a first radius, a first curved end portion, and a semi-cylindrical connector portion joining the first curved end portion to one end of the central semi-cylindrical portion. The device preferably further includes a second semi-cylindrical connector portion joining a second curved end portion to an opposite end of the central semi-cylindrical portion of the elongated body. The connector portions each have a radius less than the first radius to receive and retain the spring ring. The connector portion has a radius less than the first radius to receive and retain the ring portion of the second end of the elastic member and the first curved end portion has a radius less than an inner radius of the spring ring but greater than the radius of the connector portion. The second curved end portion also has a radius less than an inner radius of the spring ring but greater than the radius of the first and second connector portions.

An embodiment in accordance with the present disclosure may also be viewed as a spring ring retainer device for retaining a spring ring on an exercise apparatus. The retainer device includes an elongated unitary body adapted to be fastened to an anchor on the apparatus. The unitary body has a central semi-cylindrical portion having a first radius, a first curved end portion, and a semi-cylindrical connector portion joining the first curved end portion to one end of the central semi-cylindrical portion and a second curved end portion and a second semi-cylindrical connector portion joining the second curved end portion with the central semi-cylindrical portion. These portions together have a common flat surface for fastening the device to a flat anchor surface. The connector portions each have an outer radius less than an inner radius of the spring ring and the end portions each as a radius or thickness greater than the inner radius of the connector portions and less than the inner radius of the spring ring. Further, the outer end portions each have an elongated recess for passage of the spring ring there over.

Further features, advantages and characteristics of the embodiments of this disclosure will be apparent from reading the following detailed description when taken in conjunction with the drawing figures.

DETAILED DESCRIPTION

Figure 1:
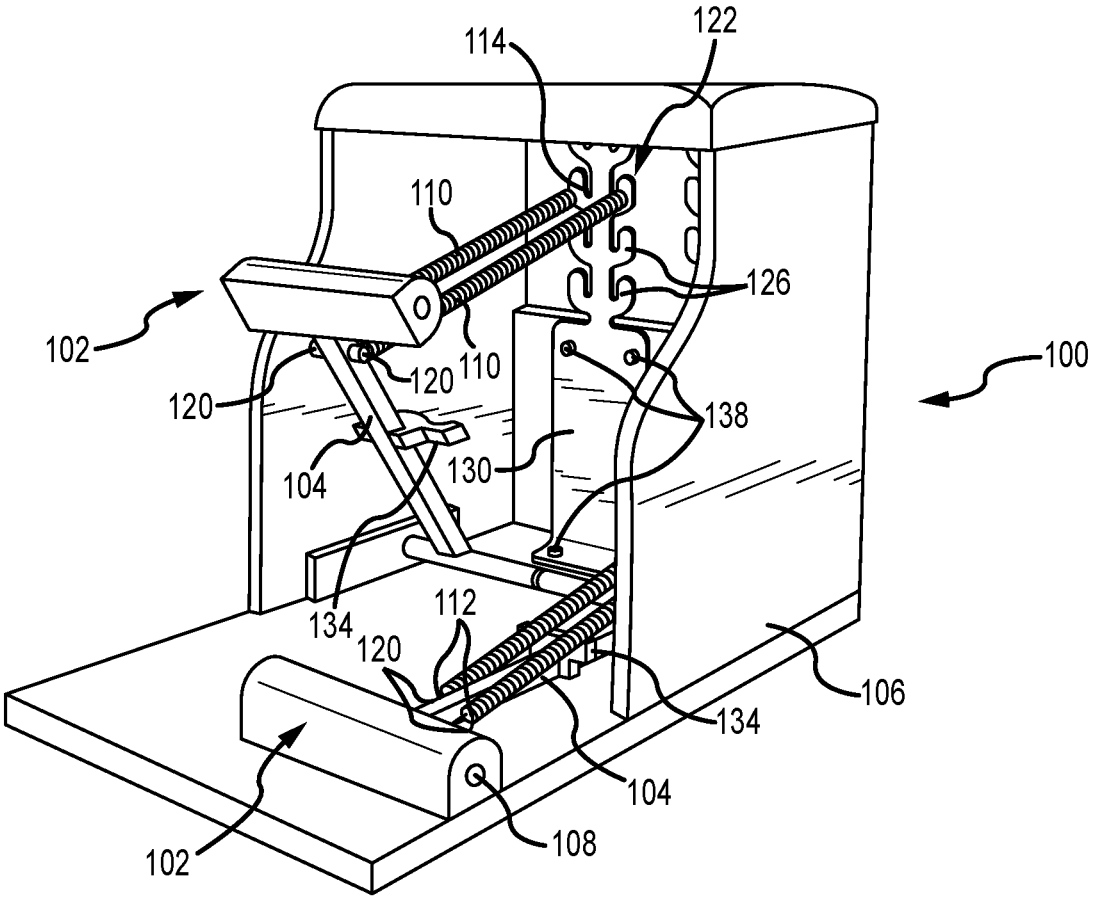
FIG.1 PRIOR ART
FIG. 1 is a perspective view of a prior art Pilates chair exercise apparatus.

A prior art Pilates-style combo chair 100 is shown in FIG. 1. This chair 100 has a pair of split steps 102. The split steps 102 may easily be converted into a single step by inserting a common dowel (not shown) horizontally through a bore 108 passing longitudinally through each of the two aligned split steps 102. As shown in FIG. 1, each step 102 is at the free distal end of a pivot arm 104. The other end of the pivot arm 104 is rotatably connected to the base of the box-like frame structure 106 using a self-lubricating bearing hinge for smooth operation and rotation of the arm 104. The step 102 is padded and covered with a non-slip material such as rubber to minimize accidental slippage of a user's hand or foot upon the step 102. One or more elastic members, such as coil springs 110, each have one end 112 connected to the pivot arm 104 via a saddle or eye strap, hook-and-eye bolt or a knob anchor 120. The other end of each spring 110 is a ring 114 that is fastened to a cactus-tree anchor 122. The cactus-tree anchor 122, shown in FIGS. 2 and 3, is described in detail further below.

The user typically performs various exercises by placing one or both feet upon the step 102, supporting the remainder of his or her body on the top of the chair 100, and performing a series of stepping movements, pushing against the steps 102. The springs 110 provide a level of resistance that may be varied by changing the combination of springs 110, and/or by moving the elastic members to different arms 126 of the cactus-tree anchor 122. For example, the combo chair 100 of FIG. 1 has two anchors 120 on each pivot arm 104 and eight arms 126 on each of the cactus-tree anchors 122 to which elastic member ends 114 may be connected. Either one or both of the springs 110 may be attached to the cactus tree anchor 122 on different arms 126. As each arm 126 is at a different position with respect to the pivot of the arm 104, the range of resistance provided by the spring 110 through the arc of motion will be different.

Figure 2:
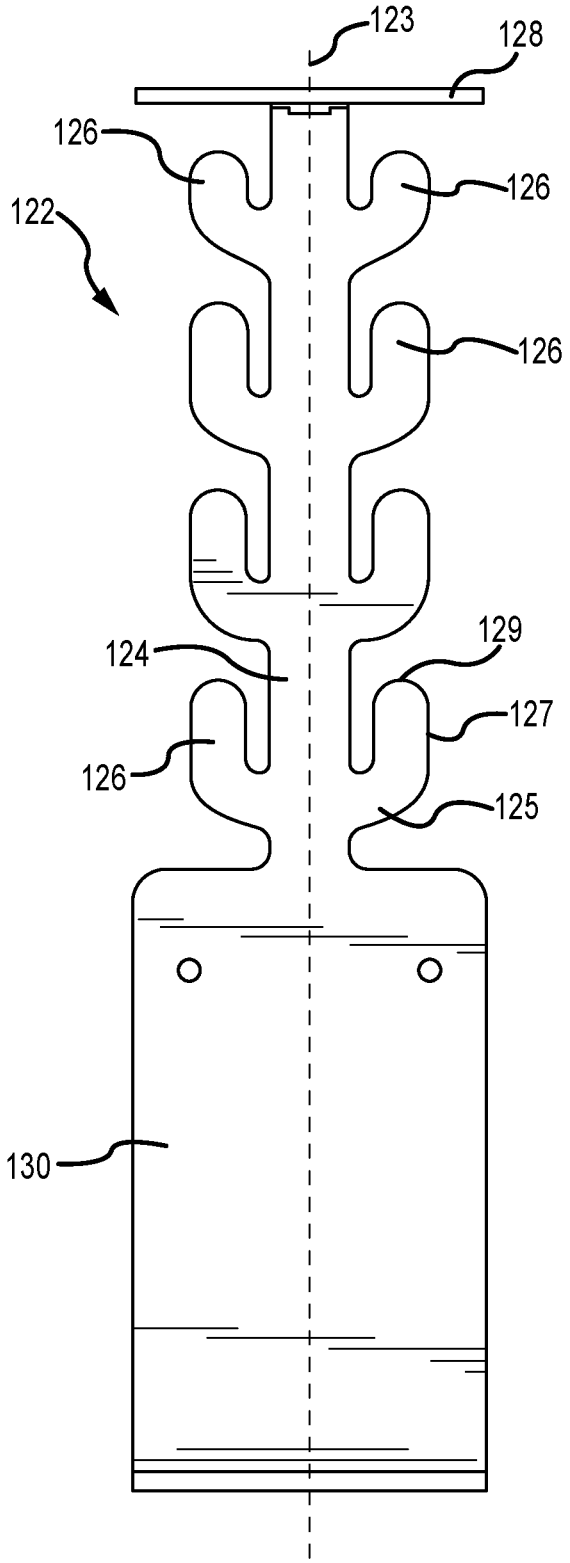
FIG.2 PRIOR ART
FIG. 2 is a front separate view of the prior art anchor plate utilized in the exercise apparatus shown in FIG. 1.
Figure 3:
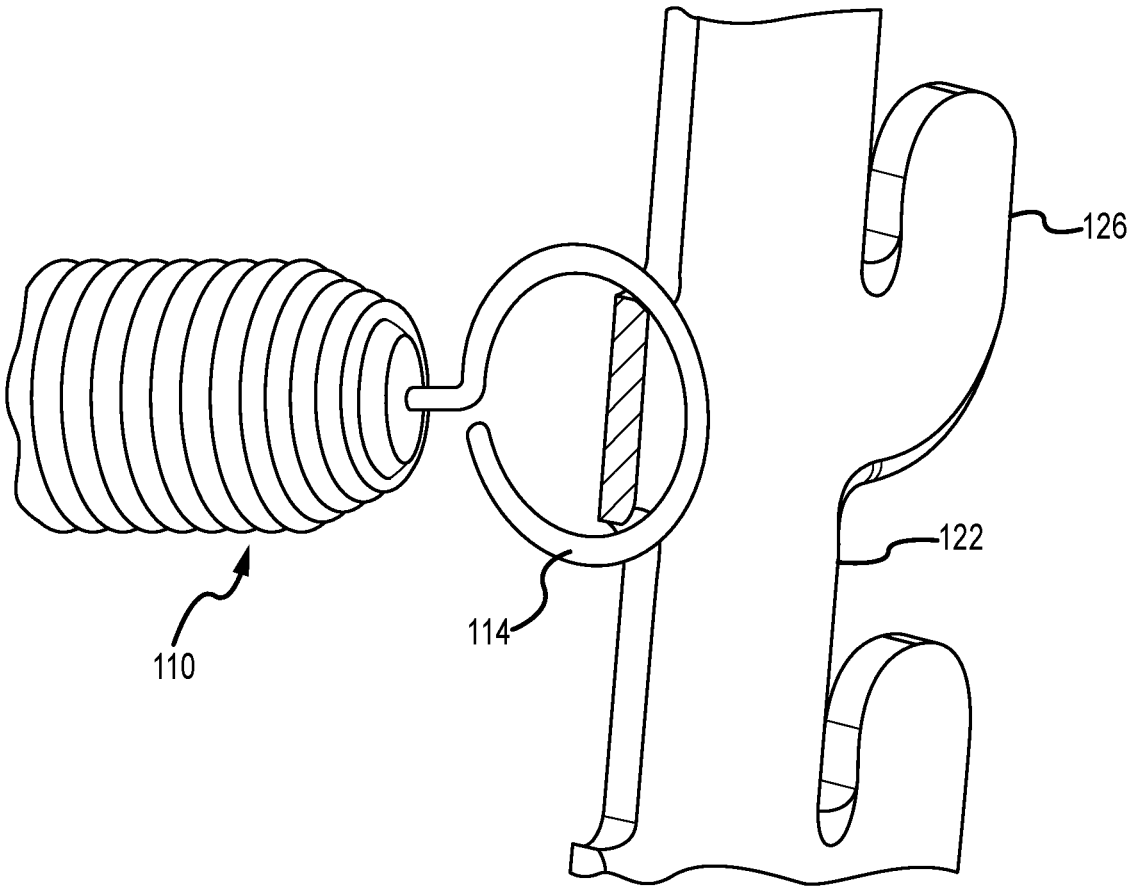
FIG.3 PRIOR ART
FIG. 3 is a partial cutaway view of a spring ring fastened to one of the arms of the prior art anchor plate shown in FIG. 2.

FIG. 2 depicts a separate front view of a prior art cactus-tree anchor 122. The anchor 122 is formed of a single piece of sheet metal such as steel. The anchor 122 has a rigid elongated central portion 124 along a central vertical axis 123 of the anchor 122. Protruding outward from the central portion 124 is a plurality of arms 126. The arms 126 protrude outward from the central portion 124 in a generally horizontal direction. Each of the arms 126 has horizontal portion 125 curving into a vertical portion 127 that is generally aligned in a vertical plane with the central vertical axis 123. The vertical portions 127 of the arms 126 extend parallel to the central portion 124 and are spaced therefrom by a gap sized to accommodate an end 114 of the springs 110. The elongated central portion 124 and the upward-pointing curved arms 126 resemble the trunk and arms of a Saguaro cactus.

The upper end of the rigid central portion 124 merges into an upper mounting member 128 that extends at right angle to the central portion 124. The upper mounting member 128 is used to connect the cactus-tree anchor 122 to the underside of the top of the frame 106 of the chair exercise apparatus 100. Similarly, the lower end of the central portion 124 forms a lower mounting member 130 used to connect to the anchor 122 to the back of the frame 106. The mounting members 128 and 130 are flat plate portions adapted to be fastened to the top and back respectively of the exercise apparatus 100 via screws or bolts 138.

Referring back to FIG. 1, the chair exercise apparatus 100 has two springs 110 attached to each pivot arm 104. Each spring 110 has its free end ring 114 free to be attached to its corresponding vertical set of arms 126 on the anchor 122 corresponding to that pivot arm 104. A user can apply either spring 110, or both, to each pivot arm 104 by simply slipping the free end ring 114 of each spring 110 over one of the arms 126 of the corresponding anchor 122. Spring tension may be changed by simply reaching behind the chair 100 and repositioning the end 114 of each spring 110 to a different anchor arm 126. When a spring 110 is not being used, it rests in one of a pair of generally U-shaped depressions or recesses in a spring cradle 134 attached to the pivot arm 104.

FIG. 3 is an enlarged schematic perspective view of one of the springs 110 attached to one of the arms 126 of the anchor 122. A portion of the arm 126 is cut away to show the two contact areas of the spring ring against the arm 126. These two contact areas are prone to wear the spring ring during chair use. Eventually this wear can cause ring failure. An early step taken to address this wear problem was to radius the curved arms 126 where the ring 114 rests on the arm 126. This reduced wear but did not prevent wear of the ring 114.

Figure 4:
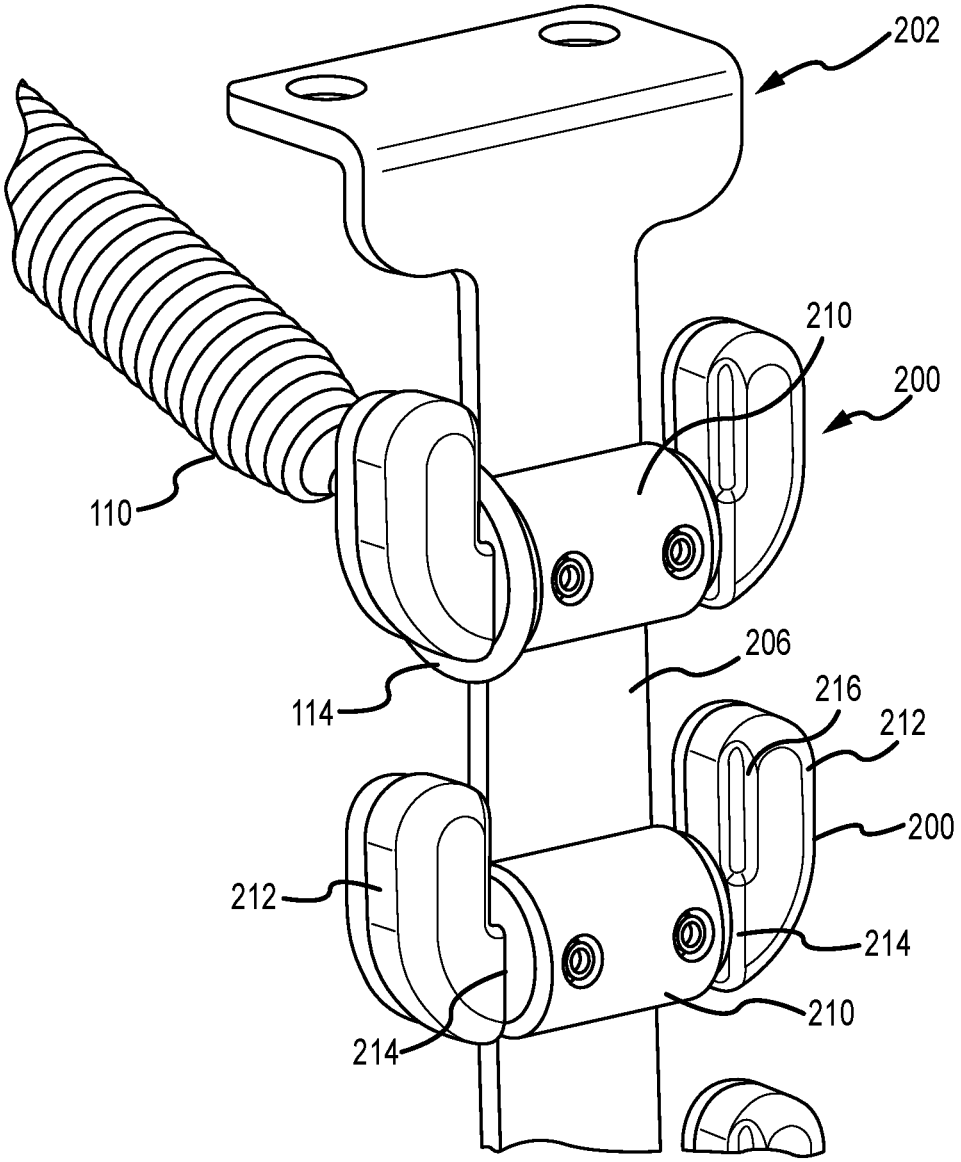
FIG. 4 is a partial perspective view of a retainer device in accordance with the disclosure fastened to a Pilates chair exercise apparatus anchor plate in accordance with the present disclosure.
Figure 5:
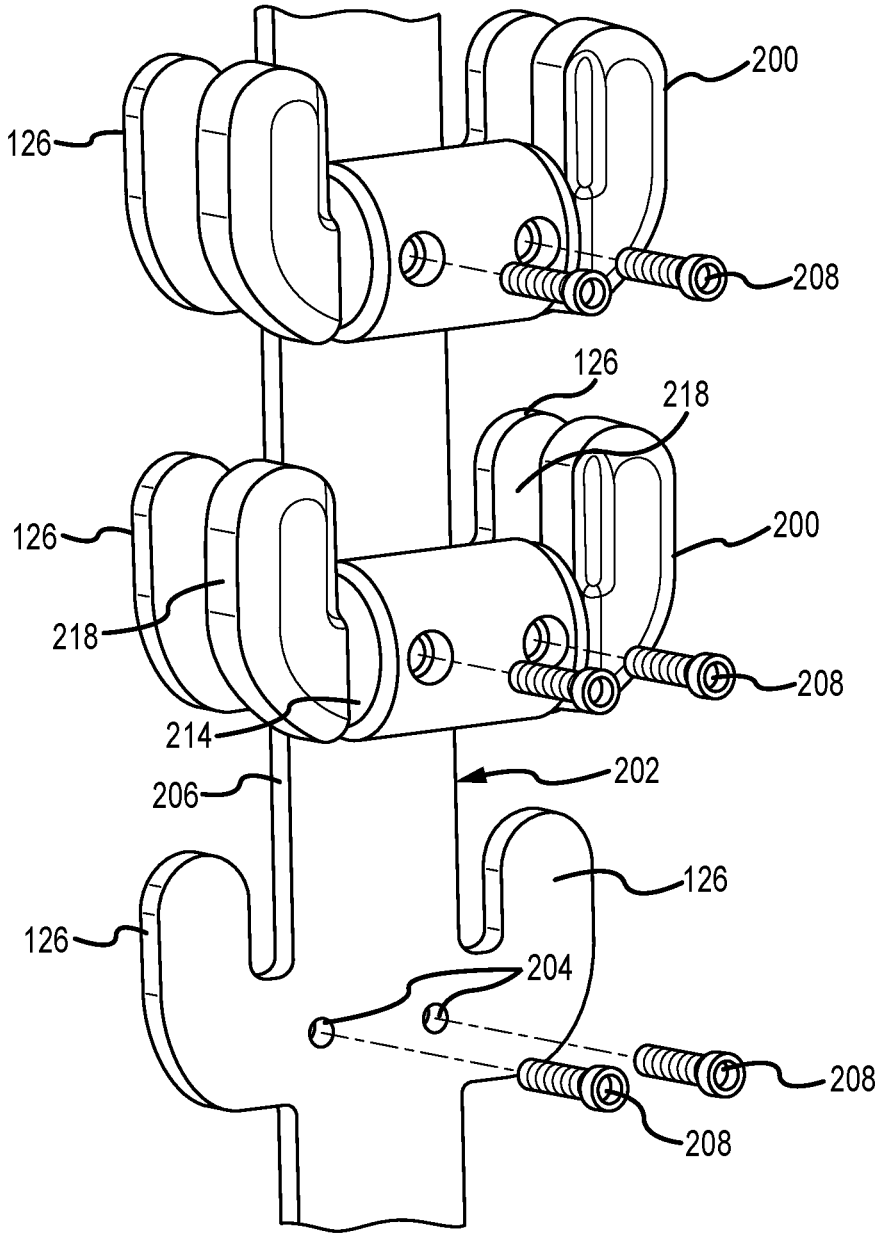
FIG. 5 is a partial exploded perspective view of the retainer device in accordance with the present disclosure shown in FIG. 4.
Figure 6:
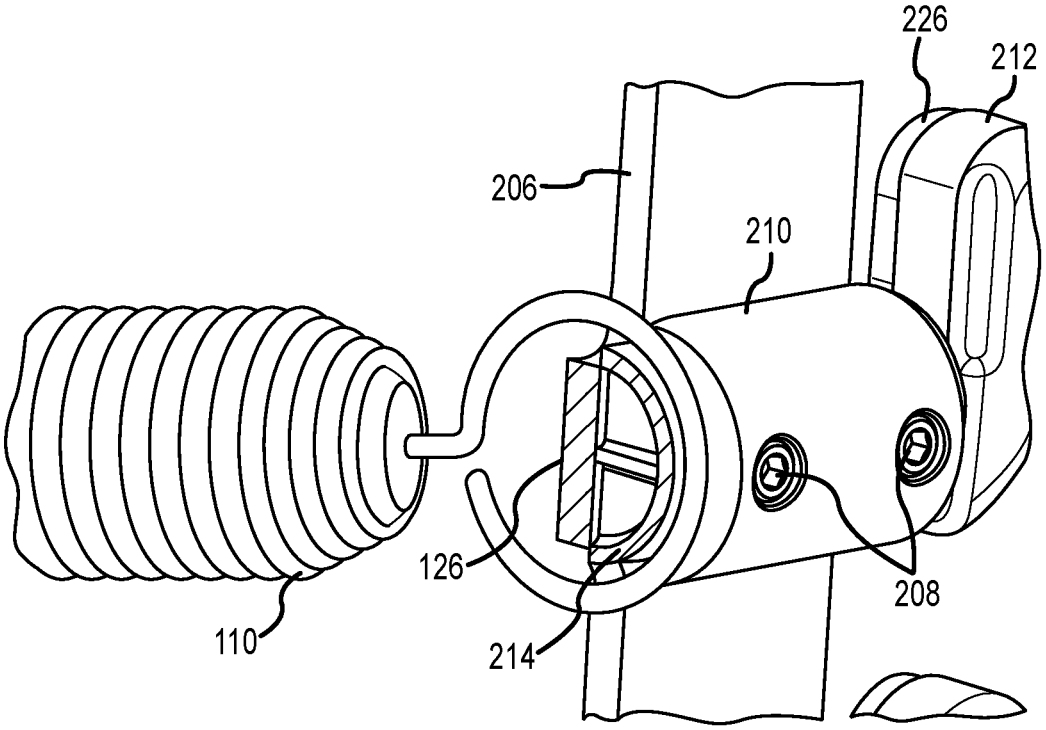
FIG. 6 is an enlarge perspective view as in FIG. 4 with portions of the anchor arm and device cut away to show the spring ring fit clearly.

One solution to this wear in accordance with the present disclosure is shown in FIGS. 4 through 6. A retainer or snugging device 200 is shown in FIG. 4 fastened to a modified chair spring anchor 202. Anchor 202 is similar to anchor 122 except that it has pairs of spaced threaded holes 204, as shown in FIG. 5, in the central portion 206 of the anchor 202. These threaded holes 204 receive screws 208 to fasten the retainer device 200 to the anchor 202 as shown in FIG. 4. In addition, radiusing of the corners of the arms 126 is no longer necessary as explained below.

Each retainer device 200 is a unitary injection molded body, preferably made of a polymer such as Nylatron from DSM Plastics, Inc. which is a tough nylon plastic with a high wear resistance, or other similar material. The unitary body is generally shaped complementary to the central portion 206 and a set of opposing arms 126. This unitary body has an elongated central semi-cylindrical portion 210 receiving screws 208 therethrough to anchor the device 200 to the central portion 206 of the anchor 202. The device 200 has a first curved end portion 212 (matching the shape of one of the arms 126) joining one end of the central semi-cylindrical portion 210 via a first semi-cylindrical connector portion 214. The device 200 also has a second curved end portion 212 (again matching the shape of one of the arms 126) joining an opposite end of the central semi-cylindrical portion 210 via a second semi-cylindrical connector portion 214. Each of the semi-cylindrical connector portions 214 has a radius less than an inner radius of the spring ring 114. The radius or thickness of each of the curved end portions 212 of the device 200 is greater than the radius of each of the connector portions 214 so that the connector portions 214 each form a groove between the end portion 214 and the central semi-cylindrical portion 210 to capture the spring ring 114 therein as is shown in FIG. 6.

In FIG. 6, the arm 126 is sectioned along with the end portion 212 removed to illustrate the configuration of the spring ring 114 in the groove of the connector portion 214. Note that in a preferred embodiment of the device 200, the outer radius of the connector portion 214 is such that the spring ring 114 is spaced from the arm 126 so as to minimize wear on the ring 114. Thus there is no longer any metal to metal contact. Such contact is completely eliminated. Instead, the ring 114 contacts the connector portion 214. In addition, the shape of the connector portion 214 distributes contact with the ring 114 over a wide arc within the ring 114 further minimizing wear on the ring 114. Finally the outer radius of each of the connector portions 214 is less than the inner radius of the spring ring 114, and the outer radius or thickness of each of the end portions 212 is greater than the outer radius of the connector portions 214 and less than the inner radius of the spring ring 114 so as to readily receive the spring ring 114 therearound. This configuration results in the spring ring 114 fitting substantially within the groove formed by the connector portion as shown in FIG. 6.

The outer shape of the end portions 212 are more rectangular than the central semi-cylindrical portion 210 and are shaped complementary to match the outer shape of the arms 126. Each end 212 may also have a corner recess 216 to facilitate insertion and removal of the spring ring 114 onto the retainer device 200. Each end 212 has an outer dimension greater than the connector portion 214 so that the ring 114 is carried within the groove formed by the connector portion 214 between the end 212 and the central portion 210. Together the portions of the unitary body of the device 200 have a flat side surface 218 for mating against the anchor 202.

It will be clear that the present disclosure is well adapted to attain the ends and advantages mentioned as well as those inherent therein. While an exemplary embodiment has been described for purposes of this disclosure, numerous changes may be made which will readily suggest themselves to those skilled in the art. For example, the end portions 214 may have a different outer shape than as specifically illustrated herein. While two fasteners 208 are shown, the device 200 could be formed so as to require only one fastener 208. The central semi-cylindrical portion 210 may be other than a right circular cylinder outer shape. It could be rectangular, for example. All such variations and changes are encompassed in the spirit of the broad scope of the present disclosure as set forth in the following claims.

The invention claimed is:

1. In an exercise apparatus having a frame, a pivoting member with a proximate end pivotally connected to the frame and a free distal end, and an elastic member having one end fastened to the pivoting member proximate to the distal end of the pivoting member, and an anchor device fastening a ring portion of a second end of the elastic member to the frame, the anchor device comprising:

an elongated support member having a central axial portion, an upper mounting portion, and a lower mounting portion, the mounting portions being fastened to the frame, the central axial portion having a plurality of outwardly extending curved arms, wherein each curved arm has a distal end sized to receive and retain the ring portion of the second end of the elastic member; and a ring retaining device fastened to the central axial portion, the device comprising:

an elongated body fastened to the central axial portion, wherein the elongated body comprises:

a central portion having a first radius;

a first curved end portion; and a semi-cylindrical connector portion joining the first curved end portion to one end of the central semi-cylindrical portion.

2. The apparatus according to claim 1 wherein the device further comprises a second semi-cylindrical connector portion joining a second curved end portion to an opposite end of the central semi-cylindrical portion.

3. The apparatus according to claim 2 wherein the connector portions each has a radius less than the first radius to receive and retain the ring portion of the second end of the elastic member.

4. The apparatus according to claim 1 wherein the connector portion has a radius less than the first radius to receive and retain the ring portion of the second end of the elastic member.

5. The apparatus according to claim 4 wherein the first curved end portion has a radius less than an inner radius of the ring portion of the second end of the elastic member but greater than the radius of the connector portion.

6. The apparatus according to claim 3 wherein the second curved end portion has a radius less than an inner radius of the ring portion of the second end of the elastic member but greater than the radius of the first and second connector portions.

7. The apparatus according to claim 6 wherein the central axial portion of the elongated support member is a flat plate.

8. The apparatus according to claim 7 wherein the central cylindrical portion, the connector portions and the curved end portions together form a flat planar surface complementary to the flat plate of the central axial portion of the elongated support member.

9. The apparatus according to claim 8 wherein the central semi-cylindrical portion of the device is fastened to the elongated support member with removable fasteners.

10. The apparatus according to claim 8 wherein the central axial portion of the elongated support member has a plurality of curved arms extending therefrom and a plurality of snugging devices fastened to the elongated support member.

11. A spring ring retainer device for retaining a spring ring on an arm of a spring anchor in a chair exercise apparatus, the retainer device comprising:

an elongated body adapted to be fastened to the anchor, the body having a central semi-cylindrical portion having a first radius, a first curved end portion, and a semi-cylindrical connector portion joining the first curved end portion to one end of the central semi-cylindrical portion.

12. The retainer device according to claim 11 further comprising a second semi-cylindrical connector portion joining a second curved end portion to an opposite end of the central semi-cylindrical portion of the elongated body.

13. The retainer device according to claim 12 wherein the connector portions each has a radius less than the first radius to receive and retain the spring ring.

14. The retainer device according to claim 11 wherein the connector portion has a radius less than the first radius to receive and retain the ring portion of the second end of the elastic member.

15. The retainer device according to claim 14 wherein the first curved end portion has a radius less than an inner radius of the spring ring but greater than the radius of the connector portion.

16. The retainer device according to claim 13 wherein the second curved end portion has a radius less than an inner radius of the spring ring but greater than the radius of the first and second connector portions.

17. A spring ring retainer device for retaining a spring ring on an exercise apparatus, the retainer device comprising:

an elongated unitary body adapted to be fastened to an anchor on the apparatus, the unitary body having a central semi-cylindrical portion having a first radius, a first curved end portion, and a semi-cylindrical connector portion joining the first curved end portion to one end of the central semi-cylindrical portion, a second curved end portion and a second semi-cylindrical connector portion joining the second curved end portion with the central semi-cylindrical portion.

18. The retainer device according to claim 17 wherein the portions together have a common flat surface for fastening the device to a flat anchor surface.

19. The retainer device according to claim 17 wherein the connector portions each has an outer radius less than an inner radius of the spring ring and the end portions each as a radius or thickness greater than the inner radius of the connector portions and less than the inner radius of the spring ring.

20. The retainer device according to claim 19 wherein the outer end portions each has an elongated recess for passage of the spring ring there over.

* * * * *